US007845519B2

(12) United States Patent
Newberry et al.

(10) Patent No.: US 7,845,519 B2
(45) Date of Patent: Dec. 7, 2010

(54) TAMPER EVIDENT PLASTIC DISPENSING CONTAINER

(75) Inventors: Michael Newberry, Poplar Grove, IL (US); Joseph P. Valley, III, Oxford, NJ (US)

(73) Assignee: J.L. Clark, Inc., Rockford, IL (US)

( * ) Notice: Subject to any disclaimer, the term of this patent is extended or adjusted under 35 U.S.C. 154(b) by 28 days.

(21) Appl. No.: 12/103,947

(22) Filed: Apr. 16, 2008

(65) Prior Publication Data

US 2009/0101674 A1 Apr. 23, 2009

Related U.S. Application Data

(60) Provisional application No. 60/912,591, filed on Apr. 18, 2007.

(51) Int. Cl.
*B67B 1/00* (2006.01)

(52) U.S. Cl. ..... 222/153.07; 222/480; 220/254.3

(58) Field of Classification Search ..... 222/153.07, 222/153.06, 480, 457.5, 142.1, 541.6, 541.4, 222/556, 561; 220/257.1, 257.2, 258.3, 258.5, 220/254.2–254.4, 265, 266, 276
See application file for complete search history.

(56) References Cited

U.S. PATENT DOCUMENTS 3,251,509 A 5/1966 Foster
3,255,928 A 6/1966 Foster
3,370,757 A 2/1968 Foster
3,587,944 A * 6/1971 Pehr ..... 222/450
4,592,480 A * 6/1986 Hart et al. ..... 220/270
4,621,744 A 11/1986 Foster
4,802,608 A * 2/1989 Hofmann ..... 222/142.1
5,052,572 A 10/1991 Pherigo
5,662,245 A * 9/1997 Grant ..... 222/153.07
6,422,411 B1 7/2002 Gray
7,021,482 B2 4/2006 Solowiejko
7,114,627 B2 10/2006 Solowiejko
2007/0056972 A1 3/2007 Solowiejko
2007/0215619 A1 9/2007 Solowiejko

OTHER PUBLICATIONS

U.S. Appl. No. 12/103,985, filed Apr. 16, 2008, Newberry et al.

* cited by examiner

*Primary Examiner*—Lien T Ngo
(74) *Attorney, Agent, or Firm*—Reinhart Boerner Van Deuren P.C.

(57) ABSTRACT

Tamper-resistance of spice container closures and containers is provided through use of tamper-evident and tamper-resistant elements. A spice container package includes a container, a closure and a tear strip, with the tear strip being joined to the closure by a first hinge, and joined to the container by a second hinge. The container includes a side wall. The closure includes a base and a cover, with the base including at least one dispensing port and the cover including at least one flap removably covering the at least one dispensing port. The first hinge connects the tear strip to the cover of the closure. The closure and the container may be integrally molded together as a single plastic component piece.

15 Claims, 5 Drawing Sheets

TAMPER EVIDENT PLASTIC DISPENSING CONTAINER

CROSS-REFERENCE TO RELATED PATENT APPLICATIONS

This patent application claims the benefit of U.S. Provisional Patent Application No. 60/912,591, filed Apr. 18, 2007, the disclosure and teachings of which are incorporated herein in their entireties, by reference.

FIELD OF THE INVENTION

This invention generally relates to closures and/or containers of the type used for spices, or the like, and more particularly to tamper-resistant closures and/or containers.

BACKGROUND OF THE INVENTION

Numerous spice container closures and/or containers are known as exemplified by U.S. Pat. Nos. 7,114,627; 7,021,482; 6,422,411; 5,052,572; 4,621,744; 3,370,757; 3,255,928; and 3,251,509; and U.S. Patent Publication No. 2007/0056972A1; all of which are assigned to the present assignee and all of which are hereby incorporated by reference in their entireties.

Although spice container closures and/or containers of the type exemplified in the patent documents listed above work well, further improvements are desirable, particularly with regard to making spice container closures and/or containers more tamper-resistant.

BRIEF SUMMARY OF THE INVENTION

The invention provides improvements in the tamper-resistance of spice container closures and/or containers through use of a container closure and/or container including tamper-evident and/or tamper-resistant elements.

In one form of the invention, a spice container package includes a container, a closure and a tear strip, with the tear strip being joined to the closure by a first hinge, and joined to the container by a second hinge. The container includes a side wall. The closure includes a base and a cover, with the base including at least one dispensing port and the cover including at least one flap removably covering the at least one dispensing port. The first hinge may connect the tear strip to the cover of the closure. The closure and the container may be integrally molded together as a single plastic component piece.

A spice container package, according to the invention, may further include a third hinge connecting the base and the cover, in such a manner that the base and cover may be folded about the third hinge into mutual engagement, and such that the closure may be folded about the first and second hinges into engagement with the container. Each of the first and second hinges may take the form of a plurality of thin tearable webs of plastic material, configured in such a manner that the tear strip may be manually torn away from the container and the cover by breakage of the thin tearable webs of plastic material.

In some forms of the invention, the at least one flap and at least one dispensing port may be configured as a plurality of flaps removably covering a plurality of dispensing ports respectively.

The base, of a closure of a spice container package according to the invention, may include a platform defining the dispensing ports and a pair of skirts depending downwardly from the platform in such a manner that the pair of skirts define a receiving channel therebetween adapted to receive a top free edge of a container. A snap lock connection may be provided between the side wall and the closure, and a tamper shield may be integrally formed around the container in spaced relation to the free edge transitioning a perimeter of the side wall to be similar to a perimeter of the outer skirt. The snap lock connection may include a plurality of locking tabs and locking slots which interlock with one another in the receiving channel.

In some forms of the invention, the cover of the closure is hinged to the container via the tear strip and the first and second hinges along a front side of the spice container package, and the cover is hinged to the base via the third hinge along a back side of the spice container package.

One form of a spice container package, according to the invention, includes a generally rectangular container, a closure having at least one flap removably covering at least one dispensing port in the closure, and a tear strip connected to the at least one flap for preventing opening of the flap. The closure includes a base and a cover, with the base having a platform and a skirt depending downward from the platform in telescoping relation with the container. The platform includes the at least one dispensing port and the cover includes the at least one flap removably covering the at least one dispensing port. The tear strip is connected to the at least one flap in such a manner that the flap is prevented from opening while the tear strip is in place. The tear strip extends at least partially over the skirt, and is adapted to be torn away to allow opening of the at least one flap.

The at least one flap may be hinged to the base proximate a back side, with the tear strip being arranged proximate to a front side. Either or both of the first and second hinges may take the form of a plurality of thin tearable webs of plastic material, such that the tear strip may be manually torn away from the container and cover by breakage of the thin tearable webs of plastic material.

The at least one flap and the at least one dispensing port may be configured as a plurality of flaps removably covering a plurality of dispensing ports, respectively, with the tear strip being independently hinged through at least one thin tearable web to each of the flaps. The base may include a platform defining the dispensing ports and inner and outer skirts depending downwardly from the platform, such that the skirts define a receiving channel therebetween which is adapted to receive a top free edge of the container. The tear strip may extend entirely over the outer skirt and be integrally connected to the side wall of the container.

In some forms of a spice container package according to the invention, the closure and the container are integrally molded together as a single plastic component piece. The cover is hinged to the container via the tear strip and the first and second hinges along a front side of the spice container package, and the cover is hinged to the base by the third hinge along a back side of the spice container package.

A spice container package, according to the invention, may be provided as a single integral molded component plastic part, including a serving lid closure and a container. The serving lid closure has at least one dispensing port and at least one flap removably covering the dispensing port. A hinge integrally connects the container and the serving lid closure. The serving lid may include a cover and a base, with the cover having the at least one flap and the cover being hinged to the container via the tear strip and the first and second hinges along a front side of the spice container package. The cover is hinged to the base along a back side of the spice container package.

In a spice container package formed as a single integral molded component plastic part, according to the invention, each of the first and second hinges may take the form of thin tearable webs of plastic material, such that the tear strip is adapted to be manually torn away from the container and the cover by breakage of the thin tearable webs of plastic material. The at least one flap and at least one dispensing port may take the form of a plurality of flaps removably covering a plurality of dispensing ports respectively. The tear strip may be independently hinged through at least one thin tearable web to each of the flaps. The base may include a platform defining the dispensing ports and inner and outer skirts depending downwardly from the platform, such that the skirts define a receiving channel therebetween adapted to receive a top free edge of the container, with the top free edge being connected to the closure by a snap connection.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1A:
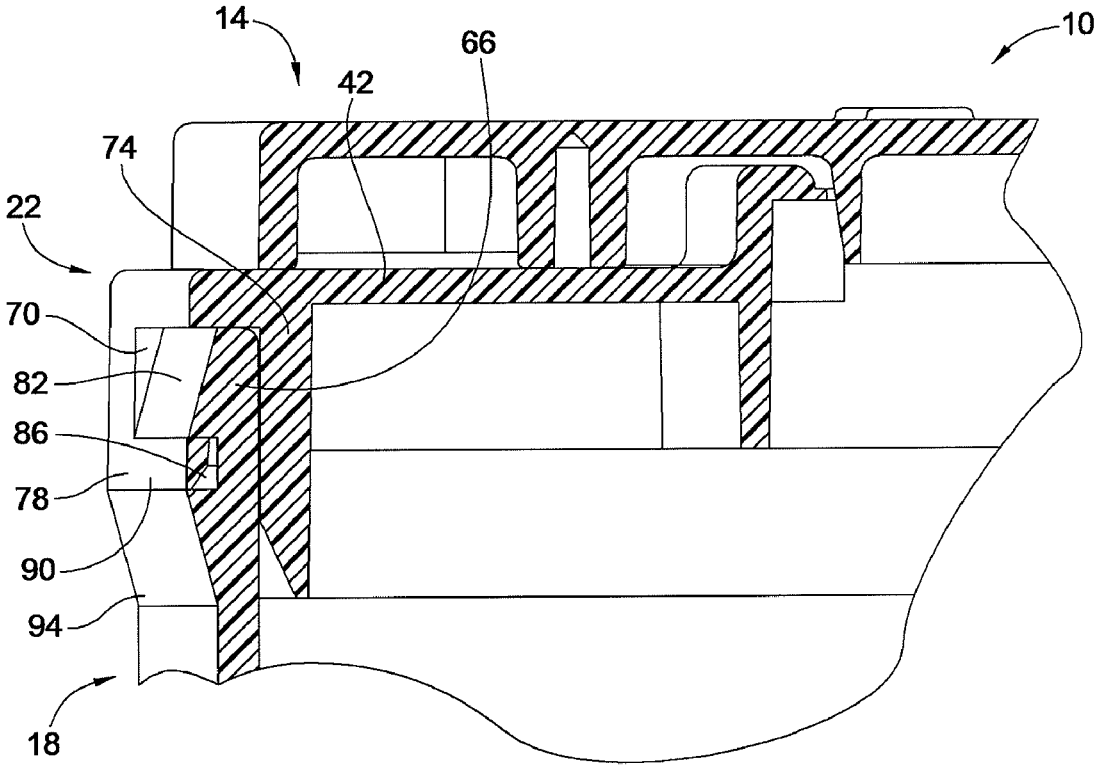
FIG. 1*a* is a cross section of a top upper portion of a spice container package shown in isometric, in accordance with an embodiment of the present invention.
Figure 1B:
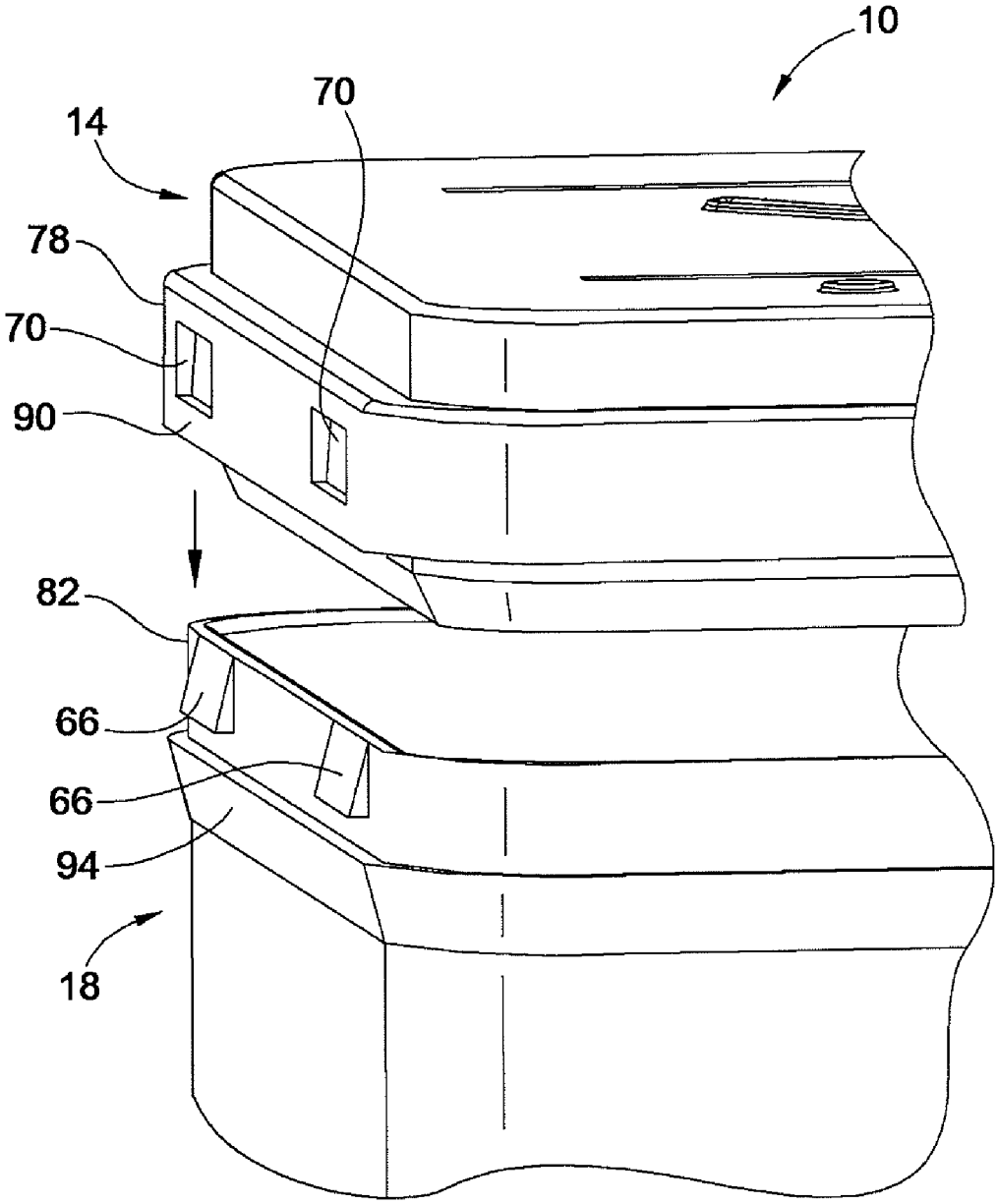
FIG. 1*b* is an isometric exploded assembly view of part of a serving lid closure and a container of the spice container package shown in FIG. 1*a;*
Figure 2:
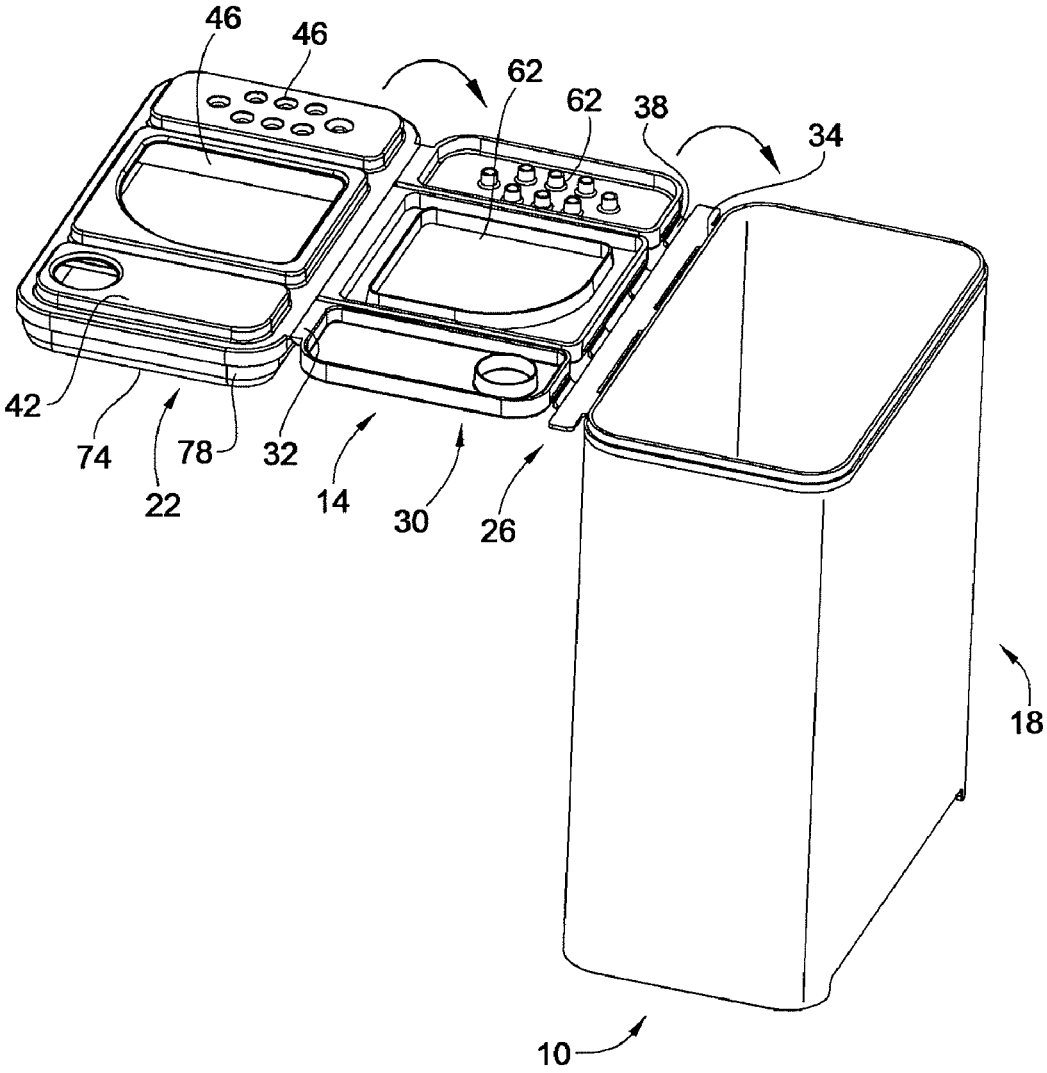
FIG. 2 is a top and side end isometric view of a molded unassembled spice container package blank (including a serving lid closure and a container) to be assembled into a spice container package, except that the tamper shield and snap lock mechanism are not shown in this drawing.
Figure 3:
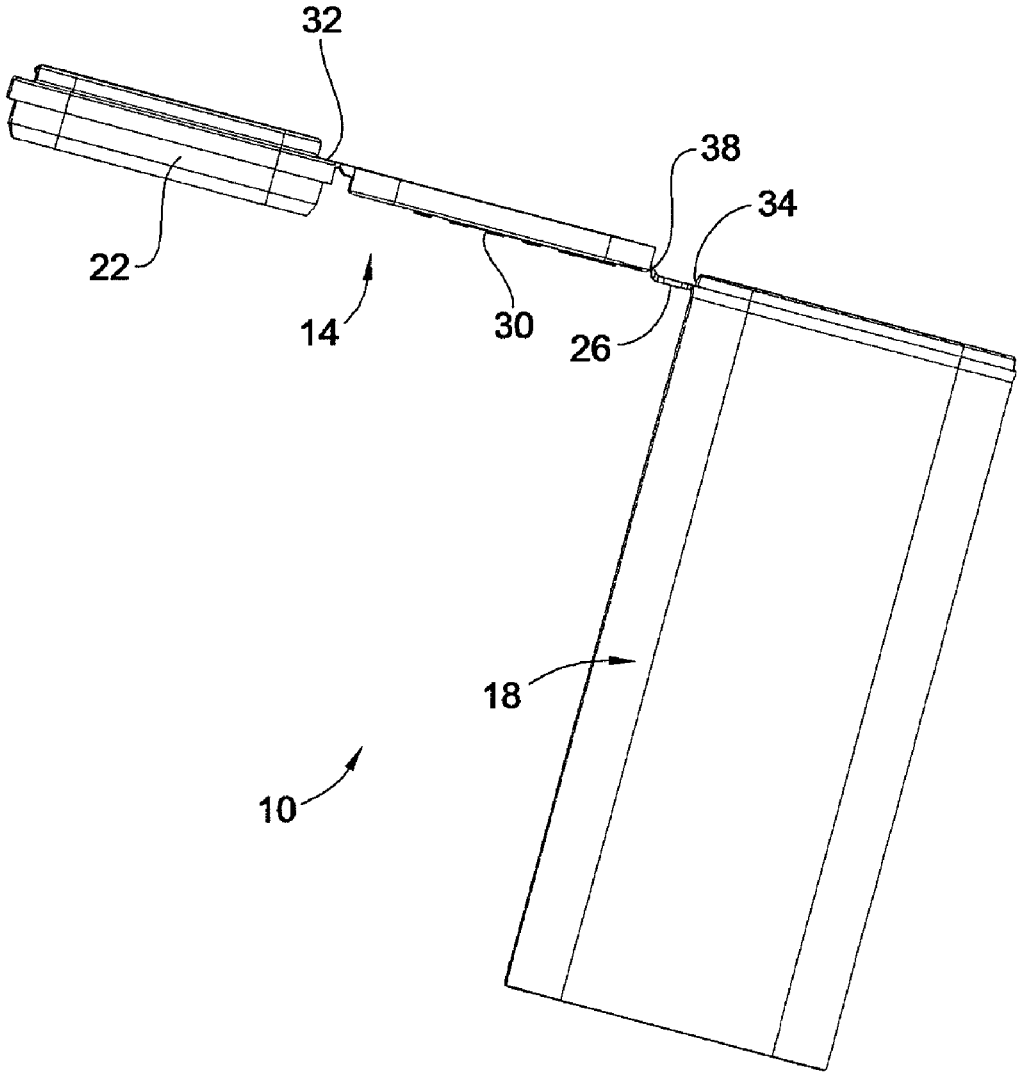
FIGS. 3 and 4 are generally side end and bottom isometric views of the molded unassembled spice container package blank shown in FIG. 2.
Figure 4:
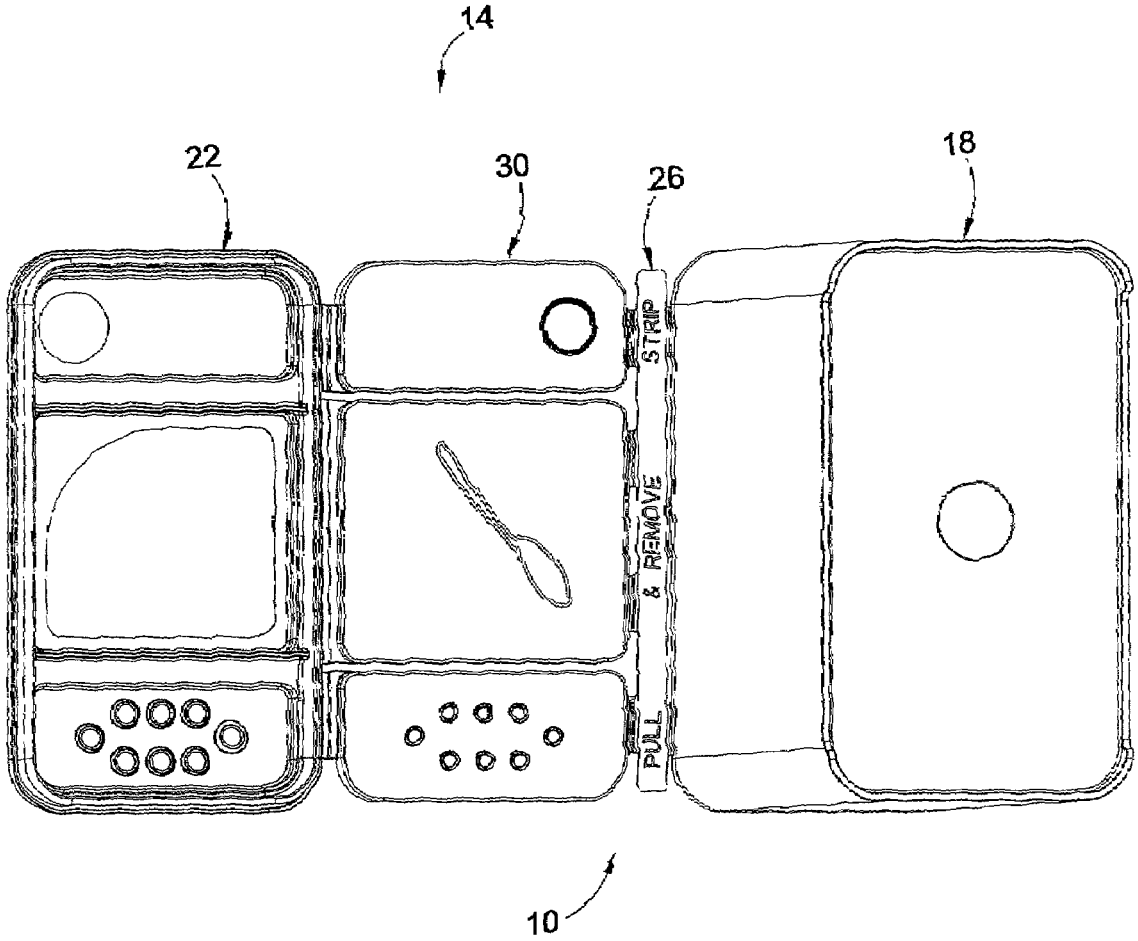

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the figures, an embodiment of the present invention is shown as a spice container package 10 including a serving lid closure 14 and a container 18. The serving lid closure 14 and the container 18 are integrally molded together of plastic material as a one piece unitarily molded. Preferably, the assembled spice container package is generally rectangular in configuration similar to many of the spice container packages as seen in supermarkets. However, inventive features may also be employed in non-rectangular package designs and/or in other closures.

While multiple pieces could be used, the serving lid closure 14 is preferably a one piece integrally molded plastic member (with the serving lid closure 14 also being integrally molded with the container) as shown in the drawings. As such, multiple molding of separate parts may not be necessitated. Additionally, the serving lid closure 14 can be molded using relatively simple molding technique between two mold halves potentially with a one pull mold process (slots 70 in outer skirt may be formed with pins from the side or may permit resilient mold release through slight flexure).

The serving lid closure 14 generally includes a base 22 and a cover 30, which are joined by an elongate hinge 32. A tamper strip 26 is disposed intermediate the cover 30 and the container 18 and joined to each of the two respective components by virtue of hinges 34 and 38, which are very thin segments of plastic material which allow the serving lid to be folded relative to the container during assembly. Specifically, during assembly, the base 22 is first folded relative to the cover 30 through hinge 32 (and the flaps may releasably snap onto the base over the dispensing port); and then the entire serving lid closure 14 is rotated and pivoted relative to the container 18 about the tamper strip 26 (via hinges 34 and 38) so that the base 22 of the serving lid closure 14 is telescopically received on the free edge of the container sidewall and can be secured directly to the top portion of the side wall of the container 18.

The hinges 34 and 38 for the tamper strip 26 are sufficiently thin to allow for manual removal and tearing such that tamper strip 26 also serves as a tear strip that can be manually removed relatively easily through manual manipulation. Typically the tamper strip 26 will include printed indicia on its front face (along the front of the package) indicating that it can be pulled and removed or otherwise indicating that it is a feature evident of tampering. In the assembled position, the tamper strip 26 is releasably and tearable away from the flaps of the cover 30 and the top of the container 18.

The base 22 includes a platform 42 through which a plurality of dispensing ports 46 are formed (e.g., such as a spoon port, a sift port and a pour port as shown). The cover 30 comprises a plurality of flaps 62 joined by hinge 32. Each flap 62 are independently movable and covers one of the dispensing ports 46 to allow for selective manual access to the dispensing ports 46 when in use. The longitudinal hinge 32 for the flaps 62 is sufficiently thin segments of plastic to allow for pivoting motion and also sufficiently thick so as to prevent inadvertent manual tear away.

A different aspect of the disclosed embodiment which can be used and employed independent of the tamper strip related features is the provision for reliably and preferably permanently locking the serving lid closure 14 to the container 18. Between the container 18 and serving lid closure 14 is provided a mounting interface with interacting snap structures located at discrete locations including as shown locking tabs 66 and locking slots 70. In the disclosed embodiment, the locking tabs 66 are formed approximate the top of the container side wall (at opposing ends and/or opposing sides), while complimentary locking slots 70 are formed into the serving lid closure 14. Alternative methods of fixing and permanently securing the serving lid to the container include welding, staking, gluing or other securing mechanisms.

As shown, the base 22 of the serving lid closure 14 includes an inner rectangular skirt 74 and an outer rectangular skirt 78, which both depend downwardly from the platform 42. The inner skirt 74 is slidably received and may engage the inner surface of the container 18 proximate a top and thereof. The outer skirt 78 which defines the locking slots 70 is received over the exterior surface of the side wall of the container 18. To assist in assembly, cam surfaces 82 and 86 are provided to facilitate temporary flexing of the outer skirt 78 outwardly away relative to the side wall of the container 18 during assembly to allow the locking tabs 66 to snap into the locking slots 70 (e.g. note the locking tabs 66 may be in the form of a wedge). Upon receipt of the locking tabs 66 into the locking slots 70, locking segments 90 formed along the lower edge of the locking slots 70 of the outer skirt 78 release back inwardly to engage the underside of the locking tab 66 to permanently secure the container 18 to the serving lid closure 14 so as to prevent easy manual removal. As shown after assembly, the resilient flexure in the outer skirt 78 is relieved once it is allowed to flex back inwardly after it clears the underside of the locking tabs 66.

Preferably, a tamper shield 94 which transitions the container sidewall to a thickness about the same (or greater if desired) than the perimeter of the outer skirt 78 is provided so as to prevent easy manual manipulation of the locking segments 90 which could allow for tampering of the serving lid closure. The tamper shield preferably extends around the periphery of the container sidewall and may be a triangular thickened region of the sidewall as shown. Thus, the design provides a mechanical lock between the closure 14 and the container 18 to greatly reduce the possibility of removal without causing visual damage to one or both of the components, particularly without the availability of tools.

To assemble the device, the cover of the serving lid closure is folded relative to the base. Thereafter, the serving lid closure and the container are pushed together in order to permanently lock the serving lid closure to the container. Thereafter, the consumer must remove the tamper evident strip in order to access the product such as spices, dry flowable granular product or other product that may be contained within the container.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A spice container package, comprising, a container having a sidewall;

a closure comprising a base and a cover, the base including at least one dispensing port and the cover including at least one flap removably covering the at least one dispensing port;

a tear strip;

a first hinge connecting the tear strip to the cover of the closure;

a second hinge connecting the tear strip to the container; and a third hinge connecting the base and the cover, and wherein the base and cover are folded about the third hinge into mutual engagement, and wherein the closure is folded about the first and second hinges into engagement with the container.

2. The spice container package of claim 1, wherein the closure and the container are integrally molded together as a single plastic component piece.

3. The spice container package of claim 1, wherein each of the first and second hinges comprises a plurality of thin tearable webs of plastic material, wherein the tear strip is adapted to be manually torn away from the container and the cover by breakage of the thin tearable webs of plastic material.

4. The spice container package of claim 3, wherein the at least one flap and the at least one dispensing port comprise a plurality of flaps removably covering a plurality of dispensing ports, respectively.

5. The spice container package of claim 4, wherein the base includes a platform defining the dispensing ports and a pair of skirts depending downwardly from the platform, the pair of skirts defining a receiving channel therebetween adapted to receive a top free edge of a container.

6. The spice container package of claim 5, further comprising a snap lock connection between the sidewall and the closure and a tamper shield integrally formed around the container in spaced relation to the free edge transitioning a perimeter of the sidewall to be similar to a perimeter of the outer skirt.

7. The spice container package of claim 6, wherein the snap lock connection comprises a plurality of locking tabs and locking slots interlocking in the receiving channel.

8. The spice container package of claim 7, wherein the cover is hinged to the container via the tear strip and the first and second hinges along a front side of the spice container package and wherein the cover is hinged to the base via the third hinge along a back side of the spice container package.

9. A spice container package, comprising:

a generally rectangular container;

a closure comprising a base and a cover, the base including a platform and a skirt depending downward from the platform in telescoping relation with the container, the platform having at least one dispensing port and the cover including at least one flap removably covering the at least one dispensing port;

a tear strip connected to the at least one flap preventing opening of the flap, the tear strip at least extending at least partially over the skirt, wherein the tear strip is adapted to be torn away to allow opening of the at least one flap;

wherein the at least one flap is hinged to the base proximate a back side; and wherein the tear strip is arranged proximate a front side;

wherein a first hinge connects the tear strip to the closure, and wherein a second hinge connects the tear strip to the container, wherein either or both of the first and second hinges comprises a plurality of thin tearable webs of plastic material, wherein the tear strip is adapted to be manually torn away from the container and the cover by breakage of the thin tearable webs of plastic material; and wherein the closure is folded about the first and second hinges into engagement with the container.

10. The spice container package of claim 9, wherein the at least one flap and the at least one dispensing port comprise a plurality of flaps removably covering a plurality of dispensing ports, respectively, and wherein the tear strip is independently hinged through at least one thin tearable web to each of the flaps.

11. The spice container package of claim 10, wherein the base includes a platform defining the dispensing ports and inner and outer skirts depending downwardly from the platform, the skirts defining a receiving channel therebetween adapted to receive a top free edge of the container.

12. The spice container package of claim 11, wherein the tear strip extends entirely over the outer skirt and is integrally connected to the sidewall of the container.

13. The spice container package of claim 12, wherein the closure and the container are integrally molded together as a single plastic component piece, wherein the cover is hinged to the container via the tear strip and first and second hinges along a front side of the spice container package and wherein the cover is hinged to the base by the third hinge along a back side of the spice container package.

14. A spice container package comprising a single integral molded component plastic part, the single integral molded component part including a serving lid closure and a container, the serving lid closure having at least one dispensing port and at least one flap removably covering the dispensing port, and wherein a hinge integrally connects the container and the serving lid closure;

wherein the serving lid closure includes a cover and a base, the cover including the at least one flap, the cover being hinged to the container via the tear strip and first and second hinges along a front side of the spice container package and wherein the cover is hinged to the base along a back side of the spice container package; and wherein the serving lid closure is folded about the first and second hinges into engagement with the container.

15. The spice container of claim 14, wherein each of the first and second hinges comprises a plurality of thin tearable webs of plastic material, wherein the tear strip is adapted to be manually torn away from the container and the cover by breakage of the thin tearable webs of plastic material and wherein the at least one flap and the at least one dispensing port comprise a plurality of flaps removably covering a plurality of dispensing ports, respectively, and wherein the tear strip is independently hinged through at least one thin tearable web to each of the flaps and wherein the base includes a platform defining the dispensing ports and inner and outer skirts depending downwardly from the platform, the skirts defining a receiving channel therebetween adapted to receive a top free edge of the container, the top free edge being connected to the closure by a snap connection.

* * * * *